United States Patent [19]

Gregorian et al.

[11] Patent Number: 4,472,165

[45] Date of Patent: Sep. 18, 1984

[54] METHOD FOR REDUCTION OF FORMALDEHYDE IN RESIN-TREATED FABRICS

[75] Inventors: Razmic S. Gregorian, Aiken; Chettoor G. Namboodri, North Augusta, both of S.C.

[73] Assignee: United Merchants and Manufacturers, Inc., New York, N.Y.

[21] Appl. No.: 422,690

[22] Filed: Sep. 24, 1982

[51] Int. Cl.[3] ..... D06M 13/34; D06M 9/00; B05D 3/02

[52] U.S. Cl. ..... 8/115.7; 8/183; 8/184; 8/185; 8/186; 427/373; 427/393.2

[58] Field of Search ..... 8/182, 183, 184, 185, 8/186, 115.6, 115.7, 149.1, 477, 495, 505, 929; 427/373, 393.2

[56] References Cited

U.S. PATENT DOCUMENTS

| | | | |
|---|---|---|---|
| 4,127,382 | 11/1978 | Perry | 8/182 X |
| 4,365,968 | 12/1982 | Gregorian et al. | 427/393.2 X |
| 4,396,391 | 8/1983 | North | 8/181 |

*Primary Examiner*—Michael R. Lusignan

*Attorney, Agent, or Firm*—Toren, McGeady and Stanger

[57] ABSTRACT

A method for the removal of free formaldehyde from textile fabrics which have been treated with formaldehyde derived resins to make the fabrics crease-resistant is disclosed. The process comprises forming a composition composed of a foaming agent, ethylene urea and an appropriate diluent and then foaming this composition to form a stable foam. The foam is then applied to the resin treated fabric in a layer, the foam is collapsed on the fabric to force it through the fabric and then the fabric is subjected to drying and curing conditions. The process is advantageous in that it utilizes relatively small volumes of liquids and thus is energy efficient and environmentally favorable.

10 Claims, No Drawings

METHOD FOR REDUCTION OF FORMALDEHYDE IN RESIN-TREATED FABRICS

BACKGROUND OF THE INVENTION

1. Field of the Invention

This invention relates to the field of treatment of crease-resistant fabrics and in particular to the reduction of the free formaldehyde contents thereof.

2. Description of the Prior Art

The finishing of cellulosic fabrics to impart wash, wear and so-called durable press properties to them usually consists in the application and reaction of an agent on the fabric. Such agents normally react to form chemical bonds or crosslinks between the long linear cellulose molecules. The agents most commonly used for these finishing techniques are methylol amides formed by the addition of formaldehyde to organic compounds of the amide class. Since the formaldehyde forms the methylol group that reacts with the cellulose and since the methylol compound must react with more than one group appendant to the cellulose for the treatment to be effective, the average molar ratio of added formaldehyde to amide compound must be greater than 1. Quite commonly, the agents used are dimethylol compounds, such as, N,N'-dimethylolethylene urea, N,N'-dimethylolurea, N,N-dimethylolethyl carbamate, N,N'-dimethylol dihydroxyethylene urea, N,N'-dimethylol triazone or methylolated melamine where the degree of methylolation ranges from 3 to 6. The etherified versions of these resins are also suitable, e.g., N,N'-dimethoxymethyl ethylene urea.

Other types of agent are also suitable for use to render fabrics crease-resistant, but in each case, they involve some type of formaldehyde derivative. Such agents ultimately have one undesirable property in common, namely, the release of formaldehyde, as those methylol groups which have not reacted with the cellulose decompose on the fabric. This occurs slowly as atmospheric moisture or laundering hydrolyzes the unreacted methylol groups. It is virtually impossible to obtain 100% reaction of the methylol groups with the fabric. Since formaldehyde is irritating even at low concentrations, fumes from fabric containing unreacted agent can be very objectionable.

Numerous attempts have been made to reduce the amount of formaldehyde in such durable press agents. Generally, these have taken the form of creating new agents which did not release as much formaldehyde. Typical of these attempts are the inventions disclosed in U.S. Pat. No. 3,755,418 and U.S. Pat. No. 3,749,751. See also U.S. Pat. No. 3,597,380.

Methods for the reduction of the formaldehyde odor wherein the fabrics are treated with certain types of scavenging agents are also known. See, for example, U.S. Pat. Nos. 3,723,058 and 3,590,100. See also U.S. Pat. No. 3,723,377.

Typically, however, inasmuch as these processes are generally carried out using the appropriate scavenging agent either dissolved or dispersed in a liquid medium, e.g., water or an organic solvent, relatively large amounts of liquid medium must be removed from the fabric during the drying operation. Consequently, a substantial amount of the cost incurred in the process resides in the liquid medium removal step.

Such liquid media present a further problem in that after they are removed, they must either be disposed of or recovered for reuse. In the case of an aqueous treatment system wherein the liquid medium is water, the water is normally disposed of as waste. In recent years, the environmental problems that relate to the disposal of water with residual chemical agents therein have become increasingly important.

With respect to organic solvents as the liquid medium, it is normally desirable to recover them because of the relatively high cost. Obviously, such recovery systems only add to the expense of the overall treatment process. Moreover, disposal of the solvent, if it is desired not to recover it, also presents environmental problems.

The foregoing problems become even more severe when textile fabrics which are highly absorbent are treated. Additionally, because of the relatively large absorption of the liquid, the weight of the wet fabric which is being handled increases significantly, and often results in processing problems and increased expense.

Methods have been developed wherein types of treating agents, e.g., dyes, and the like, can be applied to fabrics in the form of a foam. Such methods are directed to avoidance of the problems outlined above in connection with liquid removal. In particular, reference is made to U.S. Pat. Nos. 4,118,526, 4,193,762, 4,208,173, 4,266,976, 4,270,915, 4,282,729, and 4,299,591, the contents of each of which are hereby incorporated by reference.

SUMMARY OF THE INVENTION

We have discovered a method for reducing the free formaldehyde in fabrics treated with resins designed to make the fabrics crease and wrinkle resistant. This method not only produces low levels of free formaldehyde in the fabrics, it can also be carried out much more economically from a energy standpoint than the prior art processes and also avoids the environmental problems encountered in such processes.

More particularly, this is accomplished by foaming a composition composed of a foaming agent, a formaldehyde scavenger, such as, ethylene urea, urea or glycols and a diluent, to a blow ratio in the range from about 2:1 to 30:1 and a foam density in the range from about 0.5 g/cc to 0.033 g/cc. A layer of the foam thus produced is applied onto the resin treated fabric in an amount effective to chemically tie up the free formaldehyde or unreacted N-methylol groups thereon. The foam is then collapsed to force it through the fabric and the fabric is then subjected to drying and curing conditions.

DESCRIPTION OF THE PREFERRED EMBODIMENT

Generally, appropriate formaldehyde scavengers suitable for use in the present invention include ethylene urea, urea, ethylene glycol, polyols, amides, hydrazides, sorbitol, carbohydrazide and blends of such materials. Generally, the concentration of the scavenging agent in the composition would be in the range from about 0.5 to 10%, preferably from about 1 to 8%, and most preferably from 2 to 6% by weight.

The scavenger is generally mixed in with an appropriate amount of water and a foam stabilizer. Suitable foam stabilizers which can be used in the present invention include metal salts of fatty acids, e.g., potassium stearate, ammonium salts of fatty acids, e.g., ammonium stearate, sodium lauryl sulfate, ethoxylated alcohols, sulfated ethoxylated alcohols, sulfated ethoxylated phenols, coconut oil diethanolamide, disodium N-octadecylsulfo succinamide, ethoxylated dialkyl silicones, glycol polysiloxanes, fatty acid esters, fatty acid imidazolines and blends of these materials.

Further stabilization of the foam may be achieved by the addition of thickeners, e.g., polyacrylic acid, copolymers of acrylic acid, polyvinyl alcohol, natural gums, starches, starch derivatives, cellulose derivatives, synthetic polymeric compounds, water soluble polymers, organic solvent soluble polymers and blends of those compounds.

Auxiliary foam stabilizers may also be used in conjunction with the foam stabilizers or with the foam stabilizers and thickeners to obtain an added foam stability. Auxiliary foam stabilizers include lauryl alcohol, sodium laurate, lower aliphatic alcohols, dodecyl alcohol, lower aliphatic acids, lauric acid, fatty acids, hydrophilic polymers, such as, agar, polyvinyl alcohol, and sodium alginate as well as blends of these compounds.

Combinations of foam stabilizers, auxiliary foam stabilizers and thickeners can be used to give added foam stability.

Greater foam stability and optimization of the effects obtained through application of the particular scavenging agent may require pH adjustment. The specific pH range required and the additives useful for producing such a desired pH with particular foam stabilizers are conventionally known in the art. Generally, the pH will lie in the range from about 2 to 10.

Typical liquid media which may be used include water, perchloroethylene, methanol, trichloroethylene, and other conventional solvents, e.g., chlorinated hydrocarbons and aliphatic and aromatic hydrocarbon and petroleum solvents. A catalyst, such as magnesium chloride or zinc nitrate can be included in the foamable composition to increase the rate of reaction of formaldehyde and scavenger.

Generally, the composition of the present invention is capable of being whipped into a foam having a blow ratio in the range from about 2:1 to 30:1, and preferably, from about 2:1 to 20:1. The blow ratio is determined by measuring the weight of a given volume of the foam compared to the weight of the same volume of the composition prior to foaming. The foam density range is generally from about 0.5 g/cc to 0.033 g/cc and preferably from about 0.5 to 0.05 g/cc.

In order to be suitable for use in the present invention, it is important that the foam be sufficiently stable so that it does not collapse between the time when the initial foaming takes place and the time when it is applied to the substrate. The blow ratios and foam densities noted above should be stable, i.e., undergo minimal change, during the period from at least about 20 minutes and up to 24 hours after formation. Consequently, not all types of foams can be used in the present invention. For example, those foams which are of the soap bubble type, do not have sufficient stability to withstand the treatment of the coating process. When foams of this type are applied to the substrate, they immediately collapse and result in non-uniform application of the scavenger composition.

More particularly, the process of the present invention may be carried out by first mixing the appropriate components for the foamable composition, i.e., formaldehyde scavenger along with the foam stabilizer and liquid diluent, i.e., organic solvent, water, or dispersing liquid and foaming this composition utilizing a suitable mechanical foaming device, e.g., an Oakes, Godwin card, etc. The composition, after foaming, is transferred using either a knife, e.g., a floating knife, a horizontal pad, or other conventional means for applying a uniform layer of foam onto the surface of the fabric. The thus coated fabric then travels through appropriate nip rolls or a "path" which serves to collapse the foamed composition and insures that it penetrates throughout the fabric. Alternately, a vacuum may be applied to the bottom side of the fabric to draw the foam through the coated fabric. This penetration step also serves to destroy the bubbles of the foam and insures uniform penetration and application of the particular agent through the fabric, thereafter, the fabric is heated to dry and cure the scavenger.

In an alternative method of the present invention, it is possible to utilize the heat already imparted to the fabric by virtue of the treatment of the fabric with the crease-resistant agent. Thus, normally, such crease-resistant agent, e.g., urea formaldehyde resin, is applied to the fabric and the fabric is then heated to cure and dry the resin. Typically, such heating would be carried out in an oven which might have one or more heating stages, although other heating methods are common. Such heat treatment is usually carried out in a temperature range of 300°to 400° F. As a result of this heat treatment, the fabric retains a certain amount of the heat and does not immediately cool. Consequently, it is possible to apply the foamed scavenger agent composisiton of the present invention to the fabric immediately after it comes out of the curing oven. The heat retained in the fabric is sufficient to both dry and cure the scavenger agent so that a separate heating step is not required, thus allowing a significant saving in terms of utility requirements with the present invention.

The following examples illustrate the present invention.

EXAMPLE 1

A composition containing 33 parts of water, 10 parts of Valfoam RF (foaming agent), 45 parts of Valrez-1032 (urea formaldehyde resin), 3 parts of Valsof PE-19 (a polyethylene based softener) and 9 parts of Valcat #7 (magnesium chloride based catalyst solution) was prepared. The composition was foamed to a 10:1 blow ratio and 4 samples of cotton duck were knife coated with 6 mils of foam and padded at 30 psi. The wet pick-up was 35%. The samples were dried and cured at 330° F. for 3 minutes to produce a resin finished wrinkle resistant cotton fabric.

A second composition containing 5 parts of Valfoam RF, 92 parts water, 2 parts of ethylene urea, and 1 part of Valcat #7 was prepared. The composition was foamed to a 10:1 blow ratio. Two of the resin finished samples were coated with 10 mils of the foam by knife coating and the samples were vacuumed from the opposite side. They were then dried and cured at 330° F. for 3 minutes.

The samples which were treated only with foamed resin and those which were thereafter subjected to the foamed ethylene urea treatment, were analyzed for free formaldehyde. The samples which were not treated with the ethylene urea possessed an average free formaldehyde level of about 7700 ppm. Those which were treated with the foamed ethylene urea composition possessed a free formaldehyde level of about 1300 ppm.

EXAMPLE 2

Three fabric samples of 50% polyester/50% cotton were prepared as follows:

Sample 1 was a control sample which was foam finished with a durable press resin (composition A).

Sample 2 was a sample which was foam finished with composition B which contains urea scavenger in the bath.

Sample 3 was the fabric from the treatment with composition A which was then post-treated with a foamed urea (composition C).

In each case, the foam treatments were carried out utilizing a composition foamed to a blow ratio of 15:1. The foamed resin was knife-coated and the coated fabric padded to collapse the foam and distribute the finish. Wet pick-up was 30%. The fabrics were dried at 220° F. for 3 minutes and cured at 350° F. for 90 seconds.

The foamed scavenger composition (composition C) was applied to sample 3 by knife-coating, padding to collapse the foam and finally the fabric was dried at 220° F. and cured at 330° F.

The composition utilized to treat each of the fabric samples with respect to the scavenger treatment were as follows:

| | A | B | C |
|---|---|---|---|
| Water | to 100% | to 100% | to 100% |
| Valrez CM-4 (carbamate resin) | 30% | 30% | — |
| Valsof PE (softener) | 4% | 4% | — |
| Valfoam MD (sodium lauryl sulfate) | 2% | 2% | 1% |
| Valcat 251 (magnesium chloride catalyst) | 7.5% | 7.5% | — |
| Urea | — | 1.5% | 3% |

Each of the fabrics was analyzed for their durable press properties, shrinkage, tensile strength and free formaldehyde level.

| Sample | 1 | 2 | 3 |
|---|---|---|---|
| *D.P. (3 wash) | 3.8 | 3.7 | 3.8 |
| % shrinkage (3 wash w + f) | 2.0 | 2.0 | 1.4 |
| % Tensile strength retained (warp/fill) | 87/83% | 89/85% | 86/82% |
| Formaldehyde ppm | 301 | 389 | 173 |

*Durable press appearance rating - AATCC Scale #124-1973

It is evident that incorporation of scavenger in the finish composition is ineffective in reducing the formaldehyde level on the fabric (sample 2). Rather, a post reaction scavenger treatment is necessary (sample 3).

EXAMPLE 4

A series of studies were carried out on 100% cotton. Four fabric samples of the 100% cotton were treated and tested. Sample No. 1 was merely the conventional pad application of a durable press resin (composition A) and this was utilized as a control. Sample 2 was the conventional pad application of a resin containing ethylene urea as a scavenger (composition B). Sample No. 3 was the conventional pad application of a durable press resin and the fabric was then dried. A foamed ethylene urea scavenger composition (composition C) was then applied to the fabric at a 15% wet pick-up and the fabric was then subjected to curing conditions. Sample No. 4 was treated with a conventional pad application of a durable press resin, the fabric was then dried and thermally cured and then a foamed ethylene urea composition was coated onto the fabric by using a floating knife to a 15% wet pick-up and the fabric was redried.

For all four samples the wet pick-up of composition A was 70%. For samples 3 and 4, the wet pick-up of foamed scavenger composition was 15%.

The formulations utilized in each case along with are set forth in the following table. Fabrics were dried at 220° F. for five minutes and cured at 350° F. for 90 seconds.

TABLE 1

| FORMULATIONS | Composition A | Composition B | Scavenger Composition |
|---|---|---|---|
| Water | 65.65% | 64.9% | 94.0% |
| Valrez CM-4 (carbamate resin) | 25% | 25% | — |
| Valsof PE (softener) | 3% | 3% | — |
| Valdet 4016 (ethoxylated alcohol) | 0.1% | 0.1% | — |
| Valcat 251 (catalyst) | 6.25% | 6.25% | — |
| Ethylene Urea | — | 0.75% | 5.0% |
| Valfoam MD (sodiumlauryl sulfate) | — | — | 1.0% |

TABLE 2

| TEST RESULTS | *DP Rating | *% Shrinkage | Free Formaldehyde ppm |
|---|---|---|---|
| 1 Control | 3.8 | 1.4 | 1410 |
| 2 Control with EU | 3.8 | 1.6 | 1411 |
| 3 Dry-foam scavenger application, then cure | 3.6 | 1.2 | 1479 |
| 4 Dry and cure then foam scavenger application and redry | 3.8 | 1.2 | 276 |

*after three washes

EXAMPLE 5

A series of studies were carried out on 50/50 polyester/cotton. Four fabric samples of the 50/50 blend were treated and tested. Sample No. 1 was merely the conventional pad application of a durable press resin (composition A) and this was utilized as a control. Sample 2 was the conventional pad application of a resin containing ethylene urea as a scavenger (composition B). Sample No. 3 was the conventional pad application of a durable press resin and the fabric was then dried. A foamed ethylene urea scavenger composition (composition C) was then applied to the fabric at a 15% wet pick-up and the fabric was then subjected to curing conditions. Sample No. 4 was treated with a conventional pad application of a durable press resin, the fabric was then dried and thermally cured and then a foamed ethylene urea composition was coated onto the fabric by using a floating knife to a 15% wet pick-up and the fabric was redried.

For samples 1 and 2, the wet pick-up of composition A was 70%. For samples 3 and 4, the wet pick-up of foamed scavenger composition was 15%.

The formulations utilized in each case along with are set forth in the following table. Fabrics were dried at 220° F. for five minutes and cured at 350° F. for 90 seconds.

TABLE 1

| FORMULATIONS | Composition A | Composition B | Scavenger Composition |
|---|---|---|---|
| Water | 88.9% | 88.4% | 96.0% |
| Valrez CM-4 | 15% | 15% | — |
| Valsof PE | 2% | 2% | — |
| Valdet 4016 | 0.1% | 0.1% | — |
| Valcat 251 | 4.0% | 4.0% | — |
| Ethylene Urea | — | 0.5% | 3.0% |
| Valfoam MD | — | — | 1.0% |

The fabrics were then tested for their durable press rating and other properties. The results are set forth in the following table.

TABLE 2

| TEST RESULTS | *DP Rating | *% Shrinkage | Free Formaldehyde ppm |
|---|---|---|---|
| 1 Control | 3.7 | 2.2 | 893 |
| 2 Control with EU | 3.5 | 1.8 | 1898 |
| 3 Dry-foam scavenger application, then cure | 3.7 | 2.3 | 601 |
| 4 Dry and cure then foam scavenger application and redry | 3.7 | 1.6 | 163 |

*after three washes

The results indicate that for both cotton and polyester/cotton blend fabrics, the application of the foamed scavenger to a dried and cured resin treated fabric produces excellent reduction in the free formaldehyde levels of the fabric.

EXAMPLE 6

A 4 oz./yd.$^2$, 65/35 polyester/cotton plain weave fabric was finished with a composition designed to impart a wrinkle-resistant finish to the fabric. The finish composition consisted of:

| | | |
|---|---|---|
| 30% | Valrex CM-4 | (methylolated methoxyethyl carbamate resin), |
| 4% | Valsof PE | (emulsified polyethylene), |
| 2% | Valfoam MD | (sodium lauryl sulfate solution), |
| 7.5% | Valcat-251 | (aqueous solution of magnesium chloride based catalyst) |
| 56.5% | Water. | |

The finish composition was foamed to a blow ratio of 15 and applied to the fabric using a horizontal pad. The wet pick-up was 30%. The treated fabric was passed at 100 yards per minute through a three-zone oven, the temperature of the zones increasing as follows: 300° F., 330° F., 360° F.

As the hot fabric exited the oven, a foamed urea composition consisting of

3% urea, 1% Valfoam MD, and 96% water was knife-coated onto the fabric. The wet pick-up was about 15%. The latent heat of the fabric was sufficient to cause almost immediate evaporation of the water from the applied foam. The residual formaldehyde on the thus treated fabric was less than half that of the fabric without the urea treatment.

We claim:

1. A method for removing free formaldehyde from textile fabrics which have been treated with ureaformaldehyde type resins to render them crease and wrinkle-resistant comprising foaming a composition of a foaming agent, a formaldehyde scavenging agent, the concentration of the scavenging agent being in the range from about 0.5 to 10% by weight, and a diluent to a blow ratio in the range from about 2:1 to 30:1 and a foam density in the range from about 0.5 g/cc to 0.033 g/cc, applying a layer of the foam onto the resin treated fabric in an amount effective to chemically tie up the free formaldehyde thereon, and collapsing the foam to force it through the fabric, and then subjecting the fabric to drying and curing conditions.

2. The method of claim 1 wherein the scavenger foam is applied to the fabric using a floating knife.

3. The method of claim 1 wherein the thickness of the foam layer is from about 5 to 50 mils.

4. The method of claim 1 wherein the foam is applied by horizontal padding.

5. The method of claim 1 wherein the amount of foam applied to the fabric produces a wet pick-up in the range from about 5 to 30 percent by weight.

6. The method of claim 5 wherein the wet pick-up is from about 10 to 20 percent by weight.

7. The method of claim 1 wherein the foam is collapsed by mechanical means.

8. The method of claim 1, 2, 3, 4, 5 or 6, wherein the fabric containing the scavenging agent is heated at a temperature from about 300°to 350° F. in the drying and curing step.

9. The method of claim 1 wherein the formaldehyde scavenger agent is selected from the group consisting of urea, ethylene urea, ethylene glycol, polyols, amides, hydrazides, sorbitol, carbohydrazide, and combinations thereof.

10. In a method for treating textile fabric to render the fabric crease and wrinkle-resistant wherein a ureaformaldehyde type resin is applied to the fabric and the thus treated fabric is then subjected to a heat treatment to cure the resin and dry the fabric, the improvement which comprises immediately after the heat treatment and while the fabric is still hot, applying a layer of a foam prepared by foaming a composition of a foaming agent, a formaldehyde scavenging agent, the concentration of the scavenging agent being in the range from about 0.5 to 10% by weight, and a diluent to a blow ratio in the range from about 2:1 to 30:1 and a foam density in the range from about 0.5 g/cc to 0.033 g/cc, in an amount effective to chemically tie up the free formaldehyde thereon, and collapsing the foam to force it through the fabric, wherein the heat retained by the fabric is sufficient to dry and cure the scavenging agent.

* * * * *